US007137684B2

(12) United States Patent
Kim et al.

(10) Patent No.: US 7,137,684 B2
(45) Date of Patent: Nov. 21, 2006

(54) INKJET PRINTER HAVING ARBITRARILY MOUNTED CARTRIDGE AND METHOD OF RECOGNIZING THE CARTRIDGE

(75) Inventors: Jung-hwan Kim, Gyeonggi-do (KR); Young-bok Ju, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/403,804

(22) Filed: Apr. 14, 2006

(65) Prior Publication Data

US 2006/0181573 A1 Aug. 17, 2006

Related U.S. Application Data

(62) Division of application No. 10/270,722, filed on Oct. 16, 2002.

(30) Foreign Application Priority Data

Oct. 31, 2001 (KR) ..... 2001-67615

(51) Int. Cl.
*B41J 29/393* (2006.01)

(52) U.S. Cl. ..... 347/19; 347/86

(58) Field of Classification Search ..... 347/19, 347/86

See application file for complete search history.

(56) References Cited

U.S. PATENT DOCUMENTS

| | | | | |
|---|---|---|---|---|
| 4,670,857 | A * | 6/1987 | Rackman | 705/51 |
| 5,777,634 | A | 7/1998 | Okamura et al. | |
| 5,949,447 | A | 9/1999 | Arai et al. | |
| 6,151,041 | A | 11/2000 | Bolash et al. | |
| 6,325,495 | B1 * | 12/2001 | Foth | 347/84 |
| 6,467,869 | B1 | 10/2002 | Merz et al. | |
| 6,588,876 | B1 | 7/2003 | Taylor et al. | |

FOREIGN PATENT DOCUMENTS

| | | |
|---|---|---|
| KR | 08-58115 | 3/1996 |
| KR | 1998-052888 | 10/1998 |
| KR | 10-2001-111847 | 4/2001 |

* cited by examiner

*Primary Examiner*—Lamson Nguyen
(74) *Attorney, Agent, or Firm*—Staas & Halsey LLP

(57) ABSTRACT

An inkjet printer includes a main logic board having elements controlling the inkjet printer, and first and second carriers where first and second cartridges are mounted. The first and/or second cartridges are arbitrarily mounted on any one of the first and second carriers. A circuit component recognizing the arbitrarily mounted cartridge and informing an external apparatus of specifications of the recognized cartridge is provided at the main logic board. At least one of the first and second cartridges is a black or color cartridge.

9 Claims, 3 Drawing Sheets

INKJET PRINTER HAVING ARBITRARILY MOUNTED CARTRIDGE AND METHOD OF RECOGNIZING THE CARTRIDGE

CROSS-REFERENCE TO RELATED APPLICATIONS

This application is a divisional of application Ser. No. 10/270,722, filed Oct. 16, 2002, now pending. This application claims the benefit of Korean No. 2001-67615, filed Oct. 31, 2001, in the Korean Intellectual Property office, the disclosure of which is incorporated herein by reference.

BACKGROUND OF THE INVENTION

1. Field of the Invention

The present invention relates to an inkjet printer, and more particularly, to an inkjet printer having a plurality of carriers in which a cartridge is arbitrarily mounted, and to a method of recognizing the cartridge.

2. Description of the Related Art

An inkjet printer prints desired images by ejecting ink through fine nozzles of a print head. The inkjet printer uses a print cartridge including the print head and the ink. In the inkjet printer, information data for printing the images is transferred to the print cartridge through a portion of the print cartridge, wherein the print cartridge contacts a cartridge shaft along which the print cartridge is moved.

The inkjet printer may be classified into one of a thermal transfer type and a piezoelectric device type according to a method of ejecting the ink onto a sheet of print paper. In any type of the inkjet printer, since the print head of a thin film is used, each of ink droplets can be rapidly ejected from respective nozzles at a fast printing speed. Also, in the case of the thermal transfer type, since there are no moving parts, and since a switching resistor exists, reliability of the inkjet printer can be improved. Also, since, unlike a dot printer, the inkjet printer ejects the ink without contacting the sheet of the print paper, noise is decreased during printing the images on the sheet. Further, since a fan or a large power supply is not needed, a volume of the inkjet printer is reduced and a manufacturing cost thereof is lowered.

In spite of the above advantages, a conventional inkjet printer, however, has the following disadvantages.

That is, in the conventional inkjet printer, both a cartridge containing black ink (hereinafter, referred to as a black cartridge) for a black and white printing function and a cartridge containing color ink (hereinafter, referred to as a color cartridge) for a color printing function are designated to respective predetermined positions of the print cartridge. Accordingly, a user should recognize where the black cartridge and the color cartridge should be mounted in the inkjet printer to properly use the inkjet printer. It is inconvenient for the user to accurately mount the black cartridge or the color cartridge in the respective predetermined positions. Also, although a higher speed printing is possible by changing a normal print mode to a higher speed print mode, resolution is lowered and print quality deteriorates.

SUMMARY OF THE INVENTION

To solve the above-described problems, it is an object of the present invention to provide an inkjet printer in which a black cartridge or a color cartridge can be arbitrarily mounted at a cartridge mounting position so that a user can easily mount the cartridge without recognizing the cartridge mounting position. Resolution of an image printed in a higher speed print mode is prevented from being lowered.

Additional objects and advantageous of the invention will be set forth in part in the description which follows and, in part, will be obvious from the description, or may be learned by practice of the invention.

To achieve the above and other objects, there is provided an inkjet printer comprising a main logic board having elements controlling the inkjet printer, first and second carriers, wherein first and second cartridges are arbitrarily mounted in any one of the first and second carriers, and a circuit recognizing the arbitrarily mounted cartridge in the one of the first and second carriers and informing an external apparatus of specifications of the recognized cartridge, wherein at least one of the first and second cartridges is a black cartridge or a color cartridge.

To achieve the above and other objects, there is provided a method of recognizing an arbitrarily mounted cartridge, the method comprising setting a printer having a cartridge to an initialization mode, resetting the cartridge, detecting the existence of the cartridge, testing whether ink is normally ejected from a nozzle of the cartridge, recognizing the identification (ID) of the cartridge, enabling the cartridge of which the ID is recognized, and defining a position of the enabled cartridge.

The mounted cartridges are all black or color cartridges, or one is a black cartridge while the other one is a color cartridge.

The recognizing of the ID of the cartridge comprises selecting the first cartridge mounted in the first carrier, recognizing the ID of the first cartridge, determining whether the type of the first cartridge is a black cartridge or a color cartridge, selecting the second cartridge mounted in the second carrier, recognizing the ID of the second cartridge, and determining whether the type of the second cartridge is the color cartridge or the black cartridge, wherein, when it is not possible to determine the type of the first or second cartridge, an error message is displayed.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
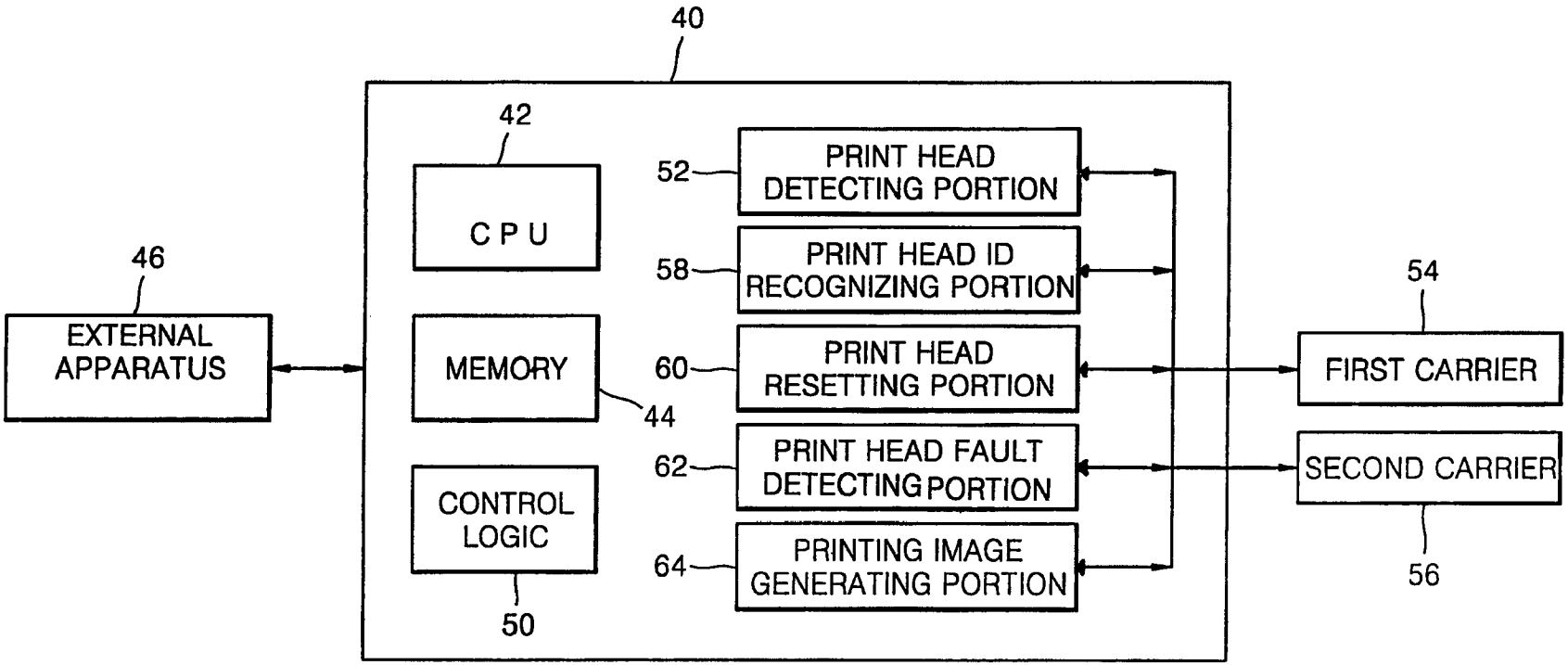
FIG. 1 is a block diagram showing the structure of an inkjet printer having an arbitrarily mountable cartridge according to an embodiment of the present invention.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Referring now to the drawings, FIG. 1 shows a printer according to an embodiment of the present invention. Reference numeral 40 denotes a main logic board of the printer controlling the printer and generating an operation signal to a cartridge to operate the cartridge. Reference numeral 42 denotes a central processing unit (CPU) of the main logic board 40. Reference numeral 44 denotes a memory storing print data, such as bit map data or output data transmitted from an external apparatus 46, such as a computer. Reference numeral 50 denotes a control logic controlling logic for receiving the bit map data output from the external apparatus 46, printing the received bit map data on a sheet of paper, and simultaneously storing the received bit map data in the memory 44.

Next, reference numeral 52 denotes a print head detecting portion recognizing the presence of the first and second cartridges which are arbitrarily mounted in one of first and second carriers 54, 56. The print head contacts a contact portion of the first and second carriers 54 and 56 connected to the main logic board 40 through respective electrical lines of a ribbon cable. That is, whether the first and second cartridges are mounted on the first and second carriers 54 and 56 are recognized.

The first and second cartridges have the same shape and size. At least one of the first and second cartridges is a black or color cartridge. Thus, both of the first and second cartridges are a black cartridge or a color cartridge, or one of the first and second cartridges is the black cartridge while the other one of the first and second cartridges is the color cartridge.

Since the first and second cartridges have the same shape and size, the first and second carriers 54 and 56 on which the first and second cartridges are mounted preferably have the same shape and size. Also, the first and second carriers 54 and 56 are provided such that whether each of the first and second cartridges mounted on the first and second carriers 54 and 56 is the black cartridge or the color cartridge can be recognized. Accordingly, since a printer user simply needs to mount a cartridge on an arbitrary one of the first and second carriers 54 and 56, the printer user does not need to accurately match the cartridge with the corresponding carrier of the conventional printer any more.

Table 1 shows four methods of mounting the first or second cartridge on the first and second carriers 54 and 56.

| | First cartridge | Second cartridge |
|---|---|---|
| Mounting Method 1 | Black cartridge | Black cartridge |
| Mounting Method 2 | Black cartridge | Color cartridge |
| Mounting Method 3 | Color cartridge | Black cartridge |
| Mounting Method 4 | Color cartridge | Color cartridge |

To apply the cartridge mounting method shown in Table 1 to an inkjet printer, what types of cartridges are mounted on the first and second carriers 54 and 56 must be recognizable. An print head ID recognizing portion 58 recognizing the types of the mounted cartridges is provided together with the print head detecting portion 52 in the main logic board 40. That is, the print head ID recognizing portion 58 recognizes whether the cartridges mounted on the carriers are a black cartridge or a color cartridge while the print head detecting portion 52 detects each state of the cartridges mounted on the respective carriers 54 and 56.

In FIG. 1, reference numeral 60 denotes a print head resetting portion resetting heads of the first and second cartridges mounted on the first and second carriers 54 and 56 prior to printing. Reference numeral 62 denotes a print head fault detecting portion detecting a fault or a malfunction of the print head according to a preset process. Reference numeral 64 denotes a printing image generating portion receiving the bit map data stored in the memory 44, generating an image corresponding to the bit map data to be printed, and transmitting the generated image to the print head.

In addition to the above, the inkjet printer includes a paper feeding portion supplying sheets of paper or a driving portion driving the first and second carriers 54 and 56. However, since these elements are basic and common structural elements in the inkjet printer, descriptions thereof will be omitted.

A print method in the inkjet printer having the above structure and functions will be described with reference to the accompanying drawings.

Figure 2:
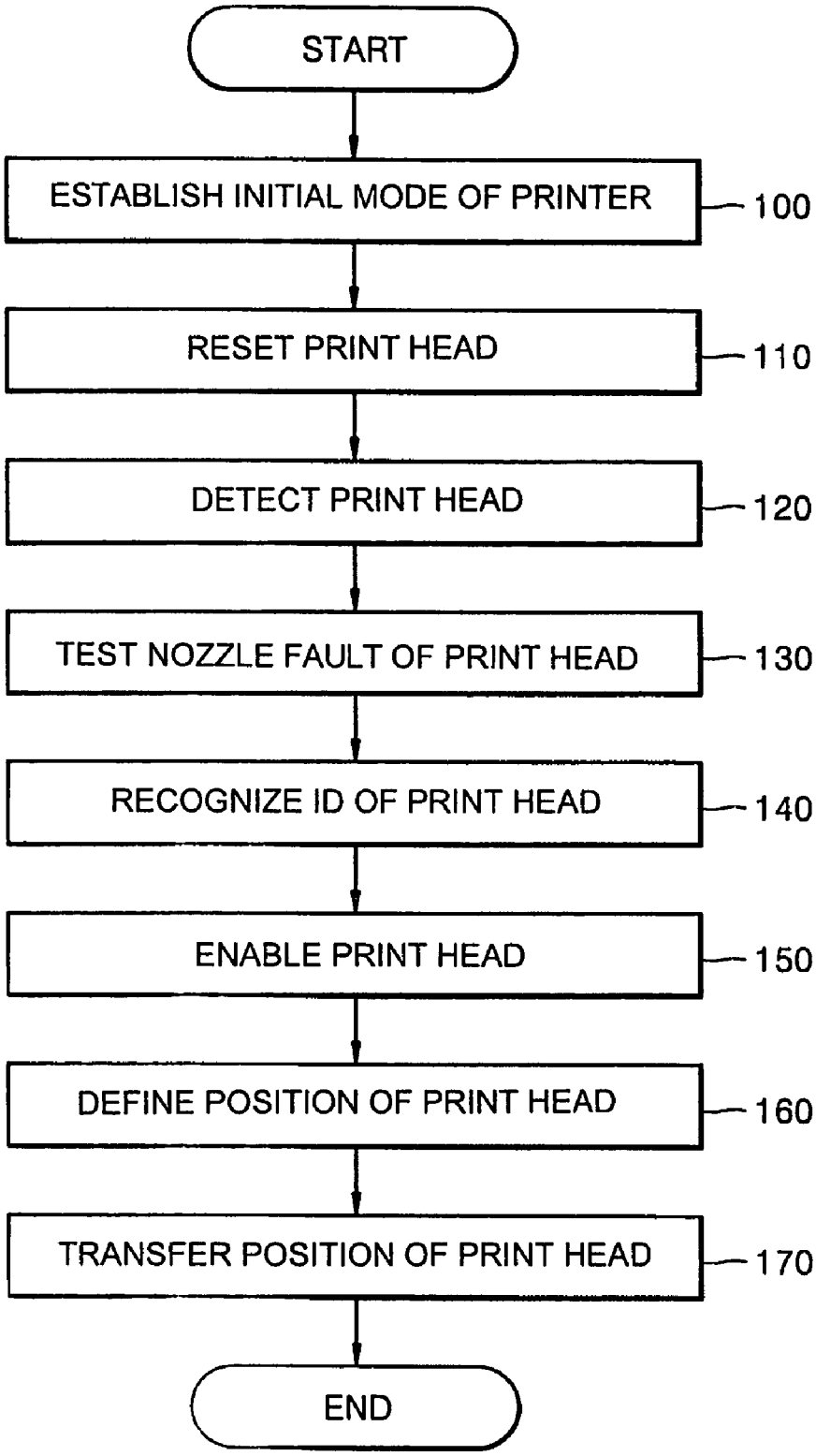
FIG. 2 is a flow chart of the inkjet printer recognizing the cartridge to perform a print function in the inkjet printer shown in FIG. 1.

Referring to FIGS. 1 and 2, in operation 100, the inkjet printer is set to an initial mode. That is, the initial mode is performed when power is supplied to the inkjet printer in the state the cartridge is mounted or when the cartridge mounted on one of the first and second carriers 54 and 56 is replaced with a new cartridge in the state the power is supplied to the inkjet printer.

In operation 110, the print head is reset, that is, settings of the print head are initialized to a print initial state when the printer is first operated or the cartridge is replaced.

In operation 120, the print head is detected, that is, whether cartridges are mounted on the first and second carriers 54 and 56 is detected.

In operation 130, the fault of a nozzle of the print head is tested, that is, whether the cartridge mounted on the carrier has any defect is detected and whether ink is normally injected from the nozzle of the cartridge is tested.

In operation 140, the print head ID is recognized. After the cartridges are mounted on the first and second carriers 54 and 56, what type of the cartridge is mounted on the first and second carriers 54 and 56 is recognized. That is, whether the mounted cartridge is the black cartridge or the color cartridge is detected. The recognition of the mounted cartridge is transmitted through respective separate lines coupled between the main control board 40 and the first and second carriers 54 and 56.

Each cartridge includes a cartridge circuit, a plurality of contacts, and a memory (not shown) storing the print head ID representing one of the black cartridge and the color cartridge. When the cartridge is mounted on one of the first and second carriers 54, 56, the print head ID is transmitted to the print head detecting portion 52 of the printer through the contacts coupled to the memory and the circuit. The printer head detection portion 52 recognizes one of the black cartridge and the color cartridge through the print head ID. Because the first and second carriers 54, 56 are not disposed on a same location with respect to print start and end positions of the printer, the first and second carriers 54, 56 are controlled to be adjusted to the print start and end positions.

When the black cartridge is mounted on the one of the first and second carriers 54, 56, the print head of the black cartridge is controlled in response to a black cartridge control signal transmitted to the black cartridge through the contracts of the one of the first and second carriers 54, 56. If the color cartridge is mounted on the one of the first and second carriers 54, 56, the print head of the color cartridge is controlled in response to a color cartridge control signal transmitted to the color cartridge through the contracts of the one of the first and second carriers 54, 56.

In operation 150, when the print head is recognized in operation 140, the cartridge is enabled.

In operation 160, the position of the print head is defined, that is, an accurate position of the mounted cartridge is defined. That is, the cartridge mounted on the first carrier 54 can be divided from the cartridge mounted on the second carrier 56 since the separate line corresponding to the cartridge is used in the operation 140.

Although, in operation 140, whether the cartridge mounted on the first or second carrier 54 or 56 is the black or color cartridge is simply recognized without considering the first and second carriers 54 and 56, in operation 160, whether the recognized cartridge is mounted on which one of the first and second carriers 54 and 56 is clearly recognized. Accordingly, the type of the cartridge mounted on the first and second carriers 54 and 56 is determined. That is, information on the cartridge mounted on the first and second carriers 54 and 56 are determined.

Meanwhile, an ID to recognize the cartridges may be provided on the surface of the cartridges. The cartridges may be recognized by the ID. That is, the first and second carriers 54 and 56 may recognize the cartridges mounted on itself using the ID.

In operation 170, the position of the print head is transferred to the main logic board 40. The type of the cartridges mounted on the first and second carriers 54 and 56 determined in operation 160 is transferred to the external apparatus 46 connected to the printer.

Then, the external apparatus 46 obtains information on an image which is printed by using the inkjet printer connected thereto. The external apparatus 46 transfers printing image data to the inkjet printer in response to the information and each specification of the cartridges. The printing image data is suitable for the specification of the cartridges mounted on the respective carriers of the inkjet printer. The printer transfers the received printing image data to the cartridges mounted on the first and second carriers 54 and 56 to print the printing image.

Here, as indicated in the Mounting Method 1 of Table 1, when both cartridges mounted on the first and second carriers 54 and 56 are black cartridges, and when the printing image corresponding to the transferred printing image data is a black and white printing image, since two cartridges with two print heads, are used for printing the printing image, a print speed is doubled compared to the print speed of the conventional inkjet printer with one print head for printing the printing image. For example, a single swath image is divided into two half images by 50% and each of the divided images is processed by each cartridge mounted on the respective carriers 54 and 56. Thus, although the print speed is doubled, the quality of the printing image is maintained.

In view of the resolution of the printing image, when the resolution of the transferred printing image is 600 dpi, a 300 dpi printing image is transferred to each cartridge mounted on the first and second carriers 54 and 56 to perform a printing function so that the printing image having a high resolution can be printed at a speed at which the 300 dpi printing image is printed. Also, by transferring the 300 dpi printing image to each cartridge and printing these printing images with a gap of 1/600 inches, the printing image having a double resolution can be printed at the speed at which the 300 dpi printing image is printed. The same results are found in the case in which both cartridges mounted on the first and second carriers 54 and 56 are color cartridges.

Meanwhile, instead of the external apparatus 46 generating the printing image to be printed in response to the specifications of the cartridges of the inkjet printer connected thereto and transferring the generated printing image to the printer, the inkjet printer may receive printing image data, such as a line of swath printing image data, transferred from the external apparatus 46, arrange or modify the printing image data in response to the specifications of the cartridges of the inkjet printer, and transfer the arranged printing image data to the cartridges to perform the printing function.

Next, the operation 140 of recognizing the cartridges mounted on the first and second carriers 54 and 56 will now be described in detail.

Figure 3:
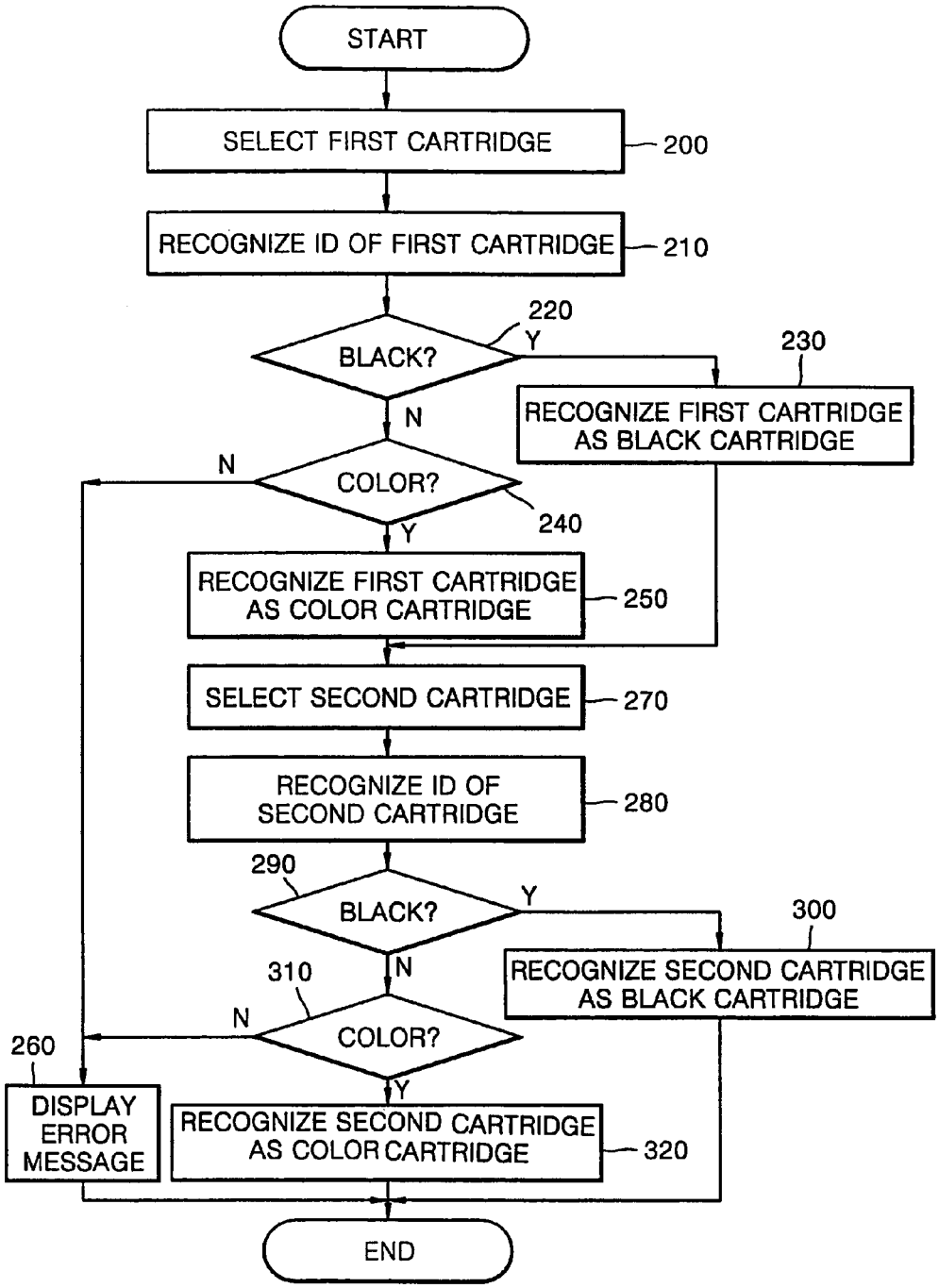
FIG. 3 is a flow chart of the inkjet printer recognizing the type of the cartridge in the flow chart shown in FIG. 2.

Referring FIG. 3, the first cartridge mounted on the first carrier 54 is selected in operation 200. The ID of the first cartridge is recognized in operation 210. That is, whether the first cartridge is the black or color cartridge is recognized. If the recognized first cartridge is determined to be the black cartridge in operation 220, then the first cartridge is recognized as the black cartridge in operation 230. If the recognized first cartridge is determined not to be the black cartridge, then it is determined in operation 240 whether the recognized first cartridge is the color cartridge. If the recognized first cartridge is determined to be the color cartridge, the recognized first cartridge is recognized as the color cartridge in operation 250. Otherwise, an error message is displayed in operation 260 and the process ends.

After the recognized first cartridge is recognized as a black or color cartridge in operation 230 or 250, the second cartridge mounted on the second carrier 56 is selected in operation 270. The ID of the selected second cartridge is recognized in operation 280. It is determined in operation 290 whether the second cartridge is the black cartridge. If the second cartridge is determined to be the black cartridge in operation 290, then the second cartridge is recognized as the black cartridge in operation 300. If the second cartridge is determined not to be the black cartridge, then whether the second cartridge is the color cartridge is determined in operation 310. If the second cartridge is determined to be the color cartridge, the second cartridge is recognized as the color cartridge in operation 320. However, if the second cartridge is determined not to be the color cartridge, because the second cartridge is neither the black cartridge nor the color cartridge, the error message is displayed in operation 260 and the process ends.

Although many items are detailed in the above description, they should be interpreted as an example of a preferred embodiment, not as one limiting the scope of the invention. For example, one skilled in the art to which the present invention pertains may embody an inkjet printer in which the ID of a cartridge is recognized while the cartridge mounted on each of the first and second carriers is detected and then a fault test of an ink injection nozzle is performed and the cartridge is enabled. Thus, the scope of the present invention must not be determined by the above-described embodiment, but determined by the technical concept defined in the following claims.

As described above, in the inkjet printer according to the present invention, the first and second carriers having the same shape and size are provided and constitutional elements recognizing the ID of a cartridge mounted on each of the first and second carriers and recognizing the mounting position of the cartridge are provided on the main logic board connected to the first and second carriers. That is, a particular cartridge, for example, a black or color cartridge, can be mounted on any of the carriers. Thus, by using the ink jet printer of the present invention, since there is no need to match a particular cartridge with a particular carrier, the cartridge can be easily mounted. Also, by mounting the black or color cartridges on both the first and second carriers, a print speed can be doubled while a normal resolution is maintained or the resolution can be doubled while printing is performed at a normal speed.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. An inkjet printer comprising:

first and second carriers each accommodating any one of a first cartridge and a second cartridge and generating a first identification signal representing the first cartridge and a second identification signal representing the second cartridge, wherein the one of the first and second cartridges is arbitrarily mounted on one of the first and second carriers; and a main logic board recognizing the arbitrarily mounted first and second cartridges in response to the first identification signal and the second identification signal transmitted through the first and second carriers, generating specifications of the arbitrarily mounted first and second cartridges when the arbitrarily mounted first and second cartridges are recognized, and controlling the arbitrarily mounted first and second cartridges to print a printing image representing one of a black and white image and a color image in accordance with the specifications of the arbitrarily mounted first and second cartridges, wherein all of the arbitrarily mounted first and second cartridges are a black cartridge for printing the black and white image, or all of the arbitrarily mounted first and second cartridges are a color cartridge for printing the color image.

2. An apparatus in an inkjet printer, comprising:

first and second carriers each receiving one of a first cartridge and a second cartridge which are arbitrarily mounted on any one of the first and second carriers, generating a first identification signal corresponding to the first cartridge arbitrarily mounted on one of the first and second carriers, and generating a second identification signal corresponding to the second cartridge arbitrarily mounted on one of the first and second carriers; and a main logic board generating printing image data in response to one of the first and second identification signals, and controlling the one of the first and second cartridges to print a printing image corresponding to the printing image data, wherein all of the first and second cartridges are a black cartridge for printing the printing image representing a black and white image or all of the first and second cartridges are a color cartridge for printing the printing image representing a color image.

3. A method in a printer, comprising:

setting the printer having first and second carriers one of which first and a second cartridges are arbitrarily mounted on, to an initialization mode for resetting the first and second cartridges of the printer;

detecting the existence of the arbitrarily mounted first and second cartridges from each of the first and second carriers;

testing whether ink is normally ejected from each nozzle of the arbitrarily mounted first and second cartridges;

recognizing each identification signal of the arbitrarily mounted first and second cartridges;

enabling the arbitrarily mounted first and second cartridges in response to respective recognized identification signals; and printing an image using the arbitrarily mounted first and second cartridges.

4. The method of claim 3, wherein both of the arbitrarily mounted cartridges are one of a black cartridge and a color cartridge, or one of the arbitrarily mounted cartridges is the black cartridge while the other one of the arbitrarily mounted cartridges is the color cartridge.

5. The method of claim 3, wherein the recognizing of the each identification signal of the arbitrarily mounted first and second cartridges, further comprises:

selecting the first cartridge arbitrarily mounted in one of the first and second carriers;

recognizing a first identification signal of the first cartridge;

determining whether the first cartridge is a black cartridge or a color cartridge in response to the first identification signal;

selecting the second cartridge arbitrarily mounted in one of the first and second carriers;

recognizing a second identification signal of the second cartridge; and determining whether the second cartridge is the color cartridge or the black cartridge in response to the second identification signal.

6. The method of claim 5, further comprising generating an error message when the first and second identification signals are not recognized.

7. A method in an inkjet printer, comprising:

providing first and second carriers, wherein one of a first cartridge and a second cartridge is arbitrarily mounted on any one of the first and second carriers;

generating a first identification signal corresponding to the first cartridge arbitrarily mounted on one of the first and second carriers;

generating a second identification signal corresponding to the second cartridge arbitrarily mounted one of the first and second carriers;

generating printing image data in response to one of the first and second identification signals;

controlling the at least one of the first and second cartridges to print a printing image corresponding to the printing image data; and controlling both of the first and second cartridges to print a black and white image when both of the first and second cartridges arbitrarily mounted in the corresponding one of the first and second carriers are a black cartridge for printing the black and to print a color image when both of the first and second cartridges arbitrarily mounted in the corresponding one of the first and second carriers are a color cartridge for printing the color image.

8. A method in an inkjet printer, comprising:

providing a first carrier, wherein one of a black cartridge for printing a black and white image and a color cartridge for printing a color image is mounted in the first carrier;

providing a second carrier, wherein one of the black cartridge and the color cartridge is mounted in the second carrier;

controlling the first carrier to print the black and white image in response to the printing image data when the black cartridge is mounted in the first carrier;

controlling the second carrier to print the black and white image in response to the printing image data when the black cartridge is mounted in the second carrier; and controlling both of the first and second carriers to print the color image in response to the printing image data representing the color image when the same type color cartridges are mounted on both of the first and second carriers.

9. A method in an inkjet printer, comprising:

providing a first carrier, wherein one of a black cartridge for printing a black and white image and a color cartridge for printing a color image is mounted in the first carrier;

providing a second carrier, wherein one of the black cartridge and the color cartridge is mounted in the second carrier;

controlling the first carrier to print the black and white image in response to the printing image data when the black cartridge is mounted in the first carrier; and controlling the second carrier to print the black and white image in response to the printing image data when the black cartridge is mounted in the second carrier, wherein the main logic board controls both of the first and second carriers to print the black and white image in response to the printing image data representing the black and white image when the same black cartridges are mounted on both of the first and second carriers.

* * * * *